US006161253A

United States Patent [19]

Tu

[11] Patent Number: 6,161,253

[45] Date of Patent: Dec. 19, 2000

[54] THREE-SECTION TYPE RETRACTABLE HANDLE

[76] Inventor: A-Shih Tu, No. 3, Chaoma 6th St., Hsitun Dist., Taichung City, Taiwan

[21] Appl. No.: 09/400,830

[22] Filed: Sep. 21, 1999

[51] Int. Cl.[7] ..... A45C 3/00; A45F 5/10

[52] U.S. Cl. ..... 16/113.1; 190/115; 280/655

[58] Field of Search ..... 16/113.1; 280/47.371, 280/47.315, 655, 655.1; 190/115

[56] References Cited

U.S. PATENT DOCUMENTS 5,367,743 11/1994 Chang ..... 16/113.1
5,694,633 12/1997 Tserng ..... 16/113.1
6,081,967 7/2000 Chang ..... 16/113.1

*Primary Examiner*—Robert J. Sandy
*Attorney, Agent, or Firm*—Rosenberg, Klein & Lee

[57] ABSTRACT

A three-section type retractable handle, which includes two fixed sleeves, two intermediate tubes respectively moved in and out of the fixed sleeves, two inner tubes respectively moved in and out of the intermediate tubes, a hollow handle connected between the inner tubes outside the intermediate tubes, an actuating bar mounted in the handle, two push rods respectively connected to two distal ends of the actuating bar and inserted into the inner tubes, a control button mounted on the handle and operated to push down the actuating bar and the push rods, two first locking units respectively mounted on the bottom end of each of the inner tubes and controlled by the control button to lock the inner tubes in the intermediate tubes alternatively between a received position and an extended position, and two second locking units respectively mounted on the bottom end of each of the intermediate tubes and controlled by the first locking units to lock the intermediate tubes in the sleeves alternatively between a received position and an extended position.

1 Claim, 4 Drawing Sheets

THREE-SECTION TYPE RETRACTABLE HANDLE

BACKGROUND OF THE INVENTION

The present invention relates to a retractable handle for a travel bag, and more particularly to a three-section type retractable handle, which is simple and inexpensive to manufacture.

A regular travel bag is generally equipped with a carrying handle and a retractable handle. Through the carrying handle, the travel bag can be carried with the hand. However, it is difficult to carry the travel bag with the hand for a long distance when the travel bag is filled up with a big amount of storage items. In this case, the retractable handle shall be used. When the retractable handle is extended out, the user can carry the retractable handle with the hand to move the travel bag on the ground for a long distance with less effort. Conventional retractable handles for travel bags are commonly of two sections, i.e., they are commonly comprised of two sleeves, two linked inner tubes moved in and out of the sleeves, and locking means for locking the inner tubes between a first position, where the inner tubes are received inside the sleeves, and a second position, where the inner tubes are extended out of the sleeves. However, conventional retractable handles have drawbacks as outlined hereinafter.

1. Space occupation:

Because conventional retractable handles are commonly of a two-section design, they still have a certain height when collapsed.

2. Limited application:

Because conventional retractable handles are commonly of a two-section design, they can only be set between two lengths. Therefore, conventional retractable handles cannot be adjusted to different lengths to fit different users.

3. Complicated structure:

Because the control mechanism and locking means of conventional retractable handles are complicated, the manufacturing cost of conventional retractable handles are high, and the assembly process of conventional retractable handles consumes much labor.

4. Complicated maintenance work:

Because the parts of the control mechanism and locking means of the conventional retractable handles are linked to one another, the whole assembly should be dismounted when making a maintenance or repair work.

SUMMARY OF THE INVENTION

The present invention has been accomplished to provide a three-section type retractable handle, which eliminates the aforesaid drawbacks. It is one object of the present invention to provide a three-section type retractable handle, which can be selectively set into different lengths to fit different users. It is another object of the present invention to provide a three-section type retractable handle, which requires less storage space when collapsed. It is still another object of the present invention to provide a three-section type retractable handle, which has a simple structure convenient for the proceeding of a maintenance work. It is still another object of the present invention to provide a three-section type retractable handle, which is inexpensive to manufacture. To achieve these and other objects of the present invention, there is provided a three-section type retractable handle, which comprises two fixed sleeves, two intermediate tubes respectively moved in and out of the fixed sleeves, two inner tubes respectively moved in and out of the intermediate tubes, a hollow handle connected between the inner tubes outside the intermediate tubes, an actuating bar mounted in the handle, two push rods respectively connected to two distal ends of the actuating bar and inserted into the inner tubes, a control button mounted on the handle and operated to push down the actuating bar and the push rods, two first locking units respectively mounted on the bottom end of each of the inner tubes and controlled by the control button to lock the inner tubes in the intermediate tubes alternatively between a received position and an extended position, and two second locking units respectively mounted on the bottom end of each of the intermediate tubes and controlled by the first locking units to lock the intermediate tubes in the sleeves alternatively between a received position and an extended position. Because the first locking units and the second locking units are separately installed in the inner tubes and the intermediate tubes, they can be separately repaired when damaged.

DETAILED DESCRIPTION OF THE PREFERRED EMBODIMENT

Figure 1:
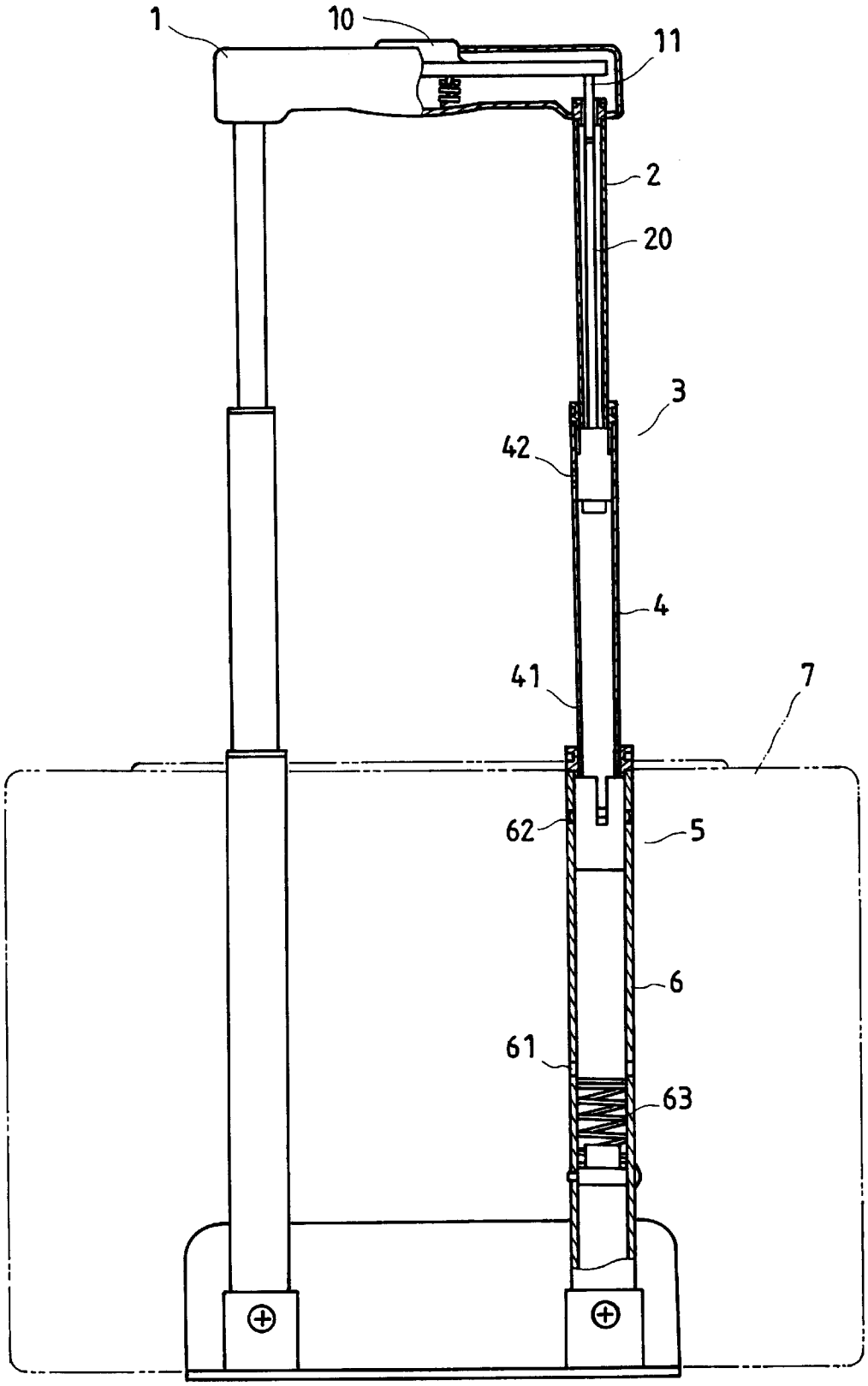
FIG. 1 is a plain view of a three-section type retractable handle according to the present invention.

Referring to the annexed drawings in detail, a three-section type retractable handle is shown a hollow handle 1, a control button 10 provided at the handle 1, a pair of sleeves 6 fixedly fastened to a travel bag 7, a pair of intermediate tubes 4 respectively moved in and out of the sleeves 6, a pair of inner tubes 2 respectively moved in and out of the intermediate tubes 4 and connected in parallel to the handle 1, two first locking units 3 respectively mounted on the inner tubes 2 at the bottom side in the intermediate tubes 4 and controlled by the control button 10 to lock the inner tubes 2 in the intermediate tubes 4, two second locking units 5 respectively mounted on the intermediate tubes 4 at the bottom side in the sleeves 6 and controlled by the first locking units 3 to lock the intermediate tubes 4 in the sleeves 6.

Referring to FIGS. from 1 through 3 again, a substantially n-shaped actuating bar 11 is mounted in the handle 1 below the control button 10. Two push rods 20 are respectively connected to the two distal ends of the actuating bar 11 and inserted through the inner tubes 2, and controlled by the control button 10 to engage into the first locking units 3.

Figure 2:
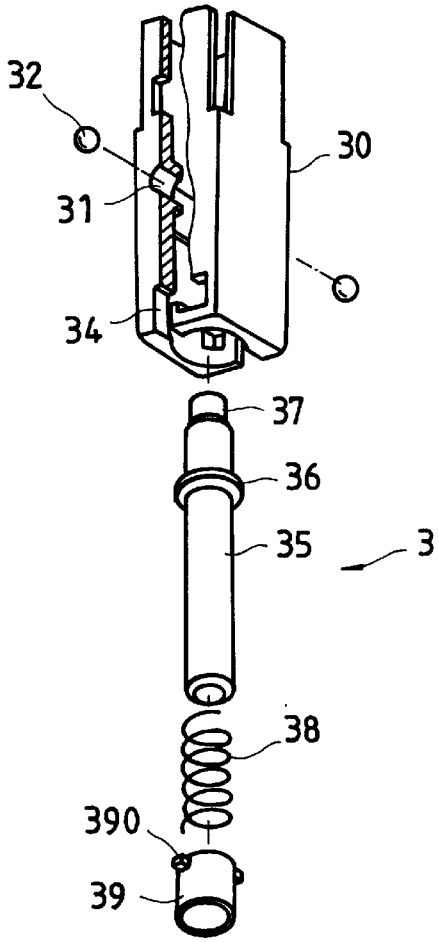
FIG. 2 is an exploded view of a first locking unit according to the present invention.
Figure 4:
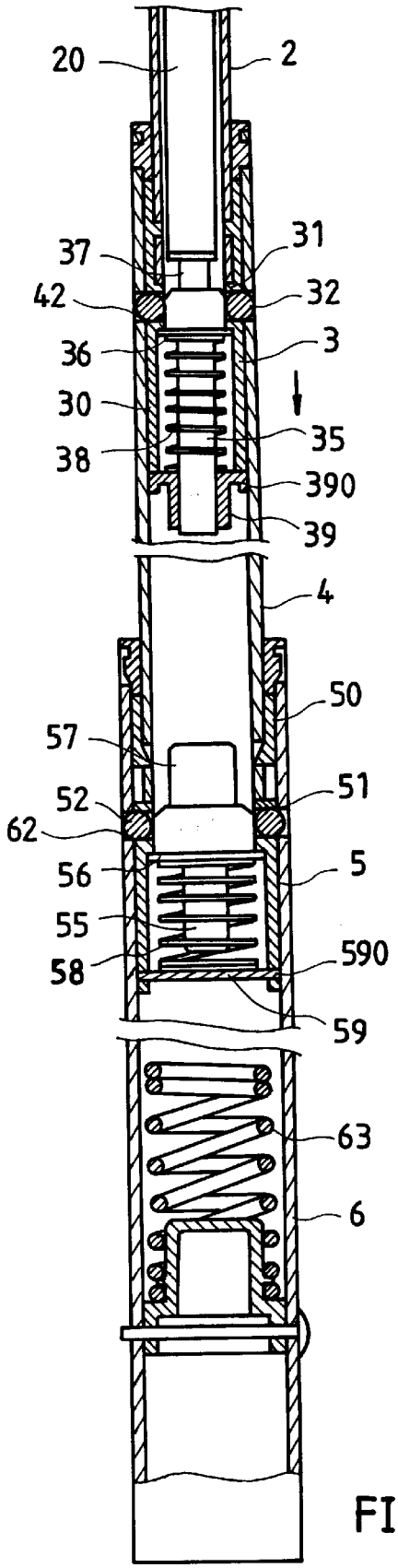
FIG. 4 is a sectional plain view of a part of the present invention, showing the retractable handle fully extended out.

Referring to FIGS. 2 and 4, the first locking unit 3 comprises a socket 30, a cylindrical control element 35, a compression spring 38, and a barrel 39. The socket 30 is axially slidably mounted in the corresponding intermediate tube 4, comprising an integrated ball holder 31 on the middle, two steel balls 32 respectively mounted in the ball holder 31 at two opposite sides, and two L-shaped retaining holes 34 respectively provided at the two opposite sidewalls at the bottom. The cylindrical control element 35 is axially movably mounted in the socket 30 and abutted against the bottom end of the push rod 20 in the corresponding inner tube 2, comprising a top neck 37, and a collar 36 rose around the periphery and stopped below the ball holder 31. The compression spring 38 is mounted on the cylindrical control element 35, and stopped between the collar 36 at the cylindrical control element 35 and the barrel 39. The barrel 39 is fastened to the inside of the socket 30 at the bottom, comprising two locating lugs 390 bilaterally raised from the periphery and respectively fastened to the retaining holes 34 at the socket 30. The cylindrical control element 35 is inserted through the barrel 39, and controlled to actuate the second locking unit 5 in the corresponding sleeve 6 (see FIG. 5). Further, each intermediate tube 4 comprises a pair of first transverse through holes 41 and a pair of second transverse through holes 42 respectively aligned near bottom and top ends thereof for receiving the steel balls 32 in the ball holder 31 of the socket 30 alternatively. The compression spring 38 imparts an upward pressure to the cylindrical control element 35, causing the steel balls 32 to be forced out of the ball holder 31 into the first transverse through holes 41 or second transverse through holes 42 at the corresponding intermediate tube 4 to lock the corresponding inner tube 2 in the extended position or received position.

Figure 3:
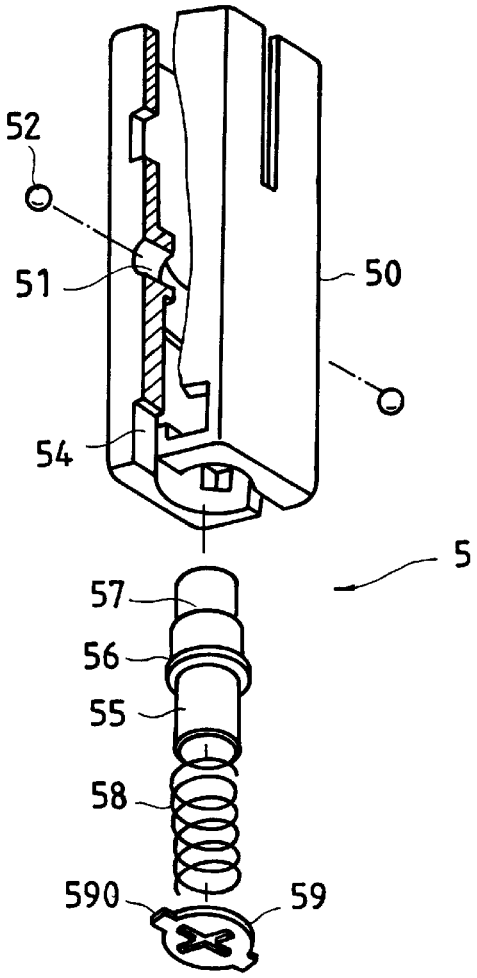
FIG. 3 is an exploded view of a second locking unit according to the present invention.

Referring to FIGS. 3 and 4, the second locking unit 5 comprises a socket 50, a cylindrical control element 55, a compression spring 58, and an end plate 59. The socket 50 is axially slidably mounted in the corresponding sleeve 6, comprising an integrated ball holder 51 on the middle, two steel balls 52 respectively mounted in the ball holder 51 at two opposite sides, and two retaining holes 54 respectively provided at the two opposite sidewalls at the bottom. The cylindrical control element 55 is axially movably mounted in the socket 50, comprising a top neck 57, and a collar 36 rose around the periphery and stopped below the ball holder 51. The compression spring 58 is mounted on the cylindrical control element 55, and stopped between the collar 56 at the cylindrical control element 55 and the end plate 59. The barrel 59 comprises two locating lugs 590 bilaterally raised from the periphery and respectively fastened to the retaining holes 54 at the socket 50. Further, each sleeve 6 comprises a buffer spring 63 at the bottom, a first pair of transverse through holes 61 and a second pair of transverse through holes 62 respectively aligned near bottom and top ends thereof for receiving the steel balls 52 in the ball holder 51 of the socket 50 alternatively.

Figure 5:
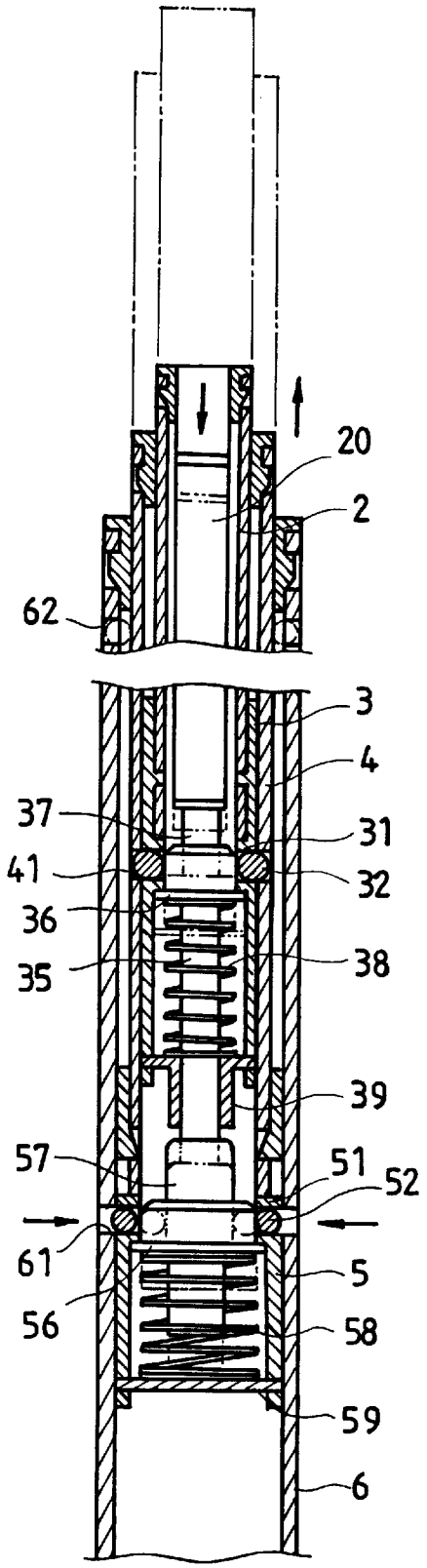
FIG. 5 is a sectional plain view of a part of the present invention, showing the inner tubes and intermediate tubes moved relative to the sleeves.

The operation of the present invention is outlined hereinafter.

a) Receiving the inner tubes 2 and the intermediate tubes:

Please refer to FIGS. 1, 4 and 5. When collapsing the retractable handle, the control button 10 is depressed to lower the actuating bar 11 and the push rods 20, causing the cylindrical control elements 35 of the first locking units 3 to be lowered with the push rods 20, and therefore the top neck 37 of each cylindrical control element 35 is moved to the ball holder 31 of the corresponding socket 30. At this time, the respective steel balls 32 are released from the outward pressure of the respective cylindrical control elements 35, and disengaged from the second transverse through holes 42 at the respective intermediate tubes 4, enabling the inner tubes 2 to be moved into the inside of the intermediate tubes 4 when the user pushing the handle 1 downwards. When the inner tubes 2 are received inside the intermediate tubes 4 and the downward pressure is released from the handle 1, the compression spring 38 of each first locking unit 3 immediately pushes the corresponding cylindrical control element 35 upwards, thereby causing the steel balls 32 to be respectively forced outwards by the cylindrical control element 35 of each first locking unit 3 into engagement with the first transverse through holes 41 at the intermediate tubes 4, and therefore the inner tubes 2 are locked in the intermediate tubes 4 in the received position. When the inner tubes 2 are received in the intermediate tubes 4 and locked (see FIG. 5), the cylindrical control elements 35 of the first locking units 3 are respectively downwardly extended out of the respective barrels 39 and pressed on the cylindrical control elements 55 of the second locking units 5. When the handle 1 is pushed downwards again, the inner tubes 2 and the intermediate tubes 4 are lowered, causing the cylindrical control elements 55 of the second locking units 5 to be lowered with the cylindrical control elements 35 of the first locking units 3, and therefore the top neck 57 of the cylindrical control element 55 of each second locking unit 5 is respectively moved to the ball holder 51 of the socket 50 of each second locking unit 5. At this time, the respective steel balls 52 are released from the outward pressure of the respective cylindrical control elements 55, and disengaged from the second transverse through holes 62 at the respective sleeves 6, enabling the intermediate tubes 4 to be moved into the inside of the sleeves 4 when the user pushing the handle 1 downwards again. When the intermediate tubes 4 are received inside the sleeves 4 and the downward pressure is released from the handle 1, the compression spring 58 of each second locking unit 5 immediately pushes the corresponding cylindrical control element 55 upwards, thereby causing the steel balls 52 to be respectively forced outwards by the cylindrical control element 55 of each second locking unit 5 into engagement with the first transverse through holes 61 at the sleeves 6, and therefore the intermediate tubes 4 are locked in the sleeves 6 in the received position.

b) Extending out the inner tubes 2 and the intermediate tubes 4:

(1) Extending out the intermediate tubes 4: Please refer to FIG. 5. When extending out the intermediate tubes 4 from the sleeves 6, the control button 10 is depressed to lower the actuating bar 11 and the push rods 20, causing the cylindrical control elements 35 of the first locking units 3 to press down the cylindrical control elements 55 of the second locking units 5. When the cylindrical control elements 55 of the second locking units 5 are lowered, the steel balls 52 of the second locking units 5 are respectively released from the first transverse through holes 61 at the sleeves 6, enabling the second locking units 5 to be pulled upwards with the intermediate tubes 4, the inner tubes 2 and the handle 1. When the intermediate tubes 4 are respectively extended out of the sleeves 6, the cylindrical control elements 55 of the second locking units 5 are respectively forced upwards by the respective compression springs 58, thereby causing the steel balls 52 to be forced outwards by the respective cylindrical control elements 55 into engagement with the second transverse through holes 62 at the sleeves 6, and therefore the intermediate tubes 4 are locked in the extended position.

Figure 6:
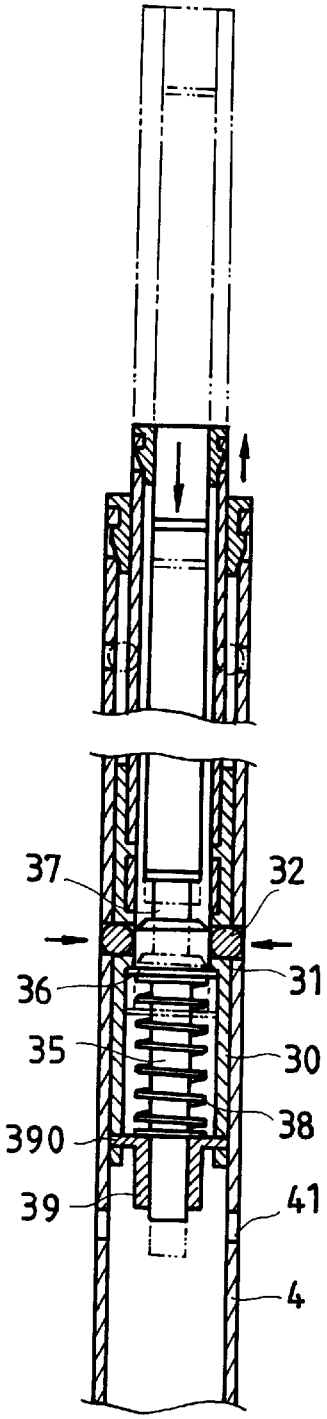
FIG. 6 is a sectional plain view of a part of the present invention, showing the inner tubes moved relative to the intermediate tubes.

(2) Extending out the inner tubes 2: Please refer to FIG. 6. When extending out the inner tubes 4 from the intermediate tubes 4, the control button 10 is depressed to lower the actuating bar 11 and the push rods 20 again, causing the cylindrical control elements 35 of the first locking units 3 to be lowered. When the cylindrical control elements 35 of the first locking units 3 are lowered, the steel balls 32 of the first locking units 3 are respectively released from the first transverse through holes 41 at the intermediate tubes 4, enabling the first locking units 3 to be pulled upwards with the inner tubes 2 and the handle 1. When the inner tubes 2 are extended out of the intermediate tubes 4, the cylindrical control elements 35 of the first locking units 3 are respectively forced upwards by the respective compression springs 38, thereby causing the steel balls 32 to be forced outwards by the respective cylindrical control elements 35 into engagement with the second transverse through holes 42 at the intermediate tubes 4, and therefore the inner tubes 2 are locked in the extended position.

While only one embodiment of the present invention has been shown and described, it will be understood that various modifications and changes could be made thereunto without departing from the spirit and scope of the invention disclosed.

What the invention claimed is:

1. A three-section type retractable handle comprising two fixed sleeves, two intermediate tubes respectively moved in and out of said fixed sleeves, said intermediate tubes each having a top end and a bottom end, two inner tubes respectively moved in and out of said intermediate tubes, said inner tubes each having a top end and a bottom end, a hollow handle connected between the top end of each of said inner tubes outside said intermediate tubes, an actuating bar mounted in said handle, two push rods respectively connected to two distal ends of said actuating bar and inserted into said inner tubes, a control button mounted on said handle and operated to push down said actuating bar and said push rods, two first locking units respectively mounted on the bottom end of each of said inner tubes and controlled by said control button to lock said inner tubes in said intermediate tubes alternatively between a received position and an extended position, and two second locking units respectively mounted on the bottom end of each of said intermediate tubes and controlled by said first locking units to lock said intermediate tubes in said sleeves alternatively between a received position and an extended position, wherein said intermediate tubes and said sleeves each have a pair of first transverse through holes near the respective bottom end and a pair of second transverse through holes near the respective top end; said first locking units each comprise a socket respectively and fixedly mounted on the bottom end of each of said inner tubes and moved with said inner tubes in said intermediate tubes, a ball holder formed integral with the socket of the respective first locking unit, two steel balls moved in and out of the ball holder of the respective first locking unit for engaging into the first transverse through holes or second transverse through holes at said intermediate tubes, a cylindrical control element controlled by said control button through said actuating bar and said push rods to release the steel balls of the respective first locking unit from the first transverse through holes and second transverse through holes at said intermediate tubes for enabling said inner tubes to be moved with said handle in and out of said intermediate tubes, and a compression spring, which imparts an upward pressure to the cylindrical control element of the respective first locking unit to force the steel balls of the respective first locking unit into engagement with the first transverse through holes or second transverse through holes at said intermediate tubes; said second locking units each comprise a socket respectively and fixedly mounted on the bottom end of each of said intermediate tubes and moved with said intermediate tubes in said sleeves, a ball holder formed integral with the socket of the respective second locking unit, two steel balls moved in and out of the ball holder of the respective second locking unit for engaging into the first transverse through holes or second transverse through holes at said sleeves, a cylindrical control element controlled by said control button through said actuating bar and said push rods and the cylindrical control elements of said first locking units to release the steel balls of the respective second locking unit from the first transverse through holes and second transverse through holes at said sleeves for enabling said intermediate tubes to be moved with said handle and said intermediate tubes in and out of said sleeves, and a compression spring, which imparts an upward pressure to the cylindrical control element of the respective second locking unit to force the steel balls of the respective second locking unit into engagement with the first transverse through holes or second transverse through holes at said sleeves.

* * * * *